US005900602A

United States Patent [19]

Bitko

[11] Patent Number: 5,900,602

[45] Date of Patent: May 4, 1999

[54] ELECTRIC SWITCH FOR ENHANCING ELECTRIC CURRENT FLOW BY QUANTUM TUNNELING EFFECT

[75] Inventor: Sheldon S. Bitko, East Brunswick, N.J.

[73] Assignee: Fifth Dimension, Inc., Trenton, N.J.

[21] Appl. No.: 09/003,498

[22] Filed: Jan. 6, 1998

[51] Int. Cl.[6] ..... H01H 35/02

[52] U.S. Cl. ..... 200/61.52; 200/61.83

[58] Field of Search ..... 200/61.45 R, 61.47, 200/61.48, 61.52, 61.83, 220–222, 230–236; 335/47–58

[56] References Cited

U.S. PATENT DOCUMENTS

| | | | |
|---|---|---|---|
| 3,851,290 | 11/1974 | Stover et al. | 337/166 |
| 4,099,040 | 7/1978 | Bitko | 200/230 |
| 4,135,067 | 1/1979 | Bitko | 200/61.52 |
| 4,513,183 | 4/1985 | Hill | 200/61.52 X |
| 5,332,876 | 7/1994 | Romano et al. | 200/61.83 X |

*Primary Examiner*—J. R. Scott

*Attorney, Agent, or Firm*—Burns, Doane, Swecker & Mathis, L.L.P.

[57] ABSTRACT

A tilt switch includes a casing in which a shorting element, such as a ball, is freely movable. An inside surface of the casing forms one fixed electrode surface, and an element projecting into the casing forms a second fixed electrode surface. The shorting element rolls along the first fixed electrode surface toward and away from the second fixed electrode surface. The chamber contains a dielectric liquid which is wettable to the first and second fixed electrode surfaces, and to the surface of the shorting element. The liquid is either a non-polar liquid or a weakly charged polar liquid. Surface tension acting on the liquid causes the surface of the shorting element to be pulled into close intimate relationship with the fixed electrode surfaces, sufficiently for an electric current to be enhanced by a quantum tunneling effect.

20 Claims, 1 Drawing Sheet

ELECTRIC SWITCH FOR ENHANCING ELECTRIC CURRENT FLOW BY QUANTUM TUNNELING EFFECT

BACKGROUND OF THE INVENTION

The present invention relates to electric switches of the type wherein at least one electrically conductive electrode is movable into and out of contact with another electrode to close or open an electric circuit.

Examples of such switches include tilt switches, reed switches, microswitches, and other mechanically, magnetically or electromagnetically driven switches.

A tilt switch is used for indicating the presence of an angular orientation through the creation of an electrical signal. Such uses range from thermostat controls and motion detectors, to ordinance devices and liquid level controls, among others. When the switch tilts, an electrically conductive medium moves along one fixed electrode and into contact with another fixed electrode to act as a shorting element. Liquid mercury provides an ideal conductive medium in such a case, because mercury can selectively wet certain areas, i.e., the electrode surfaces, without wetting the insulative surfaces. However, mercury possesses substantial drawbacks such as environmental pollution and toxicity. It is thus desirable to provide a non-mercury alternative to the mercury switch.

Workers attempting to satisfy that need have devised switches comprised of a casing forming a chamber containing a gaseous environment (e.g., argon) in which there is disposed a mobile conductive element, e.g., a gold plated ball, adopting the role of mercury. Strategically disposed within the chamber are fixed electrodes, i.e., fixed with respect to the casing. The gold plated ball functions as a movable electrode and as an alternative to the free flowing mercury. Thus, when the ball simultaneously contacts the fixed electrodes, an electrical signal is transferred. Those devices, however, suffer from low current carrying or switching capacity, high contact resistance, short life and/or electrical bounce.

The low current carrying capacity and high contact resistance occur even though the ball and fixed electrodes are in physical contact with one another, due to a shortage of contact area as a result of the irregular (non-smooth) surfaces of the electrodes. That is, even though electrodes may appear to be smooth, they exhibit microscopic irregularities, defining peaks and valleys. Actual contact between the surfaces occurs at opposing peaks, and may be insufficient to achieve a desired current flow especially if the non-contacting portions of the electrodes are spaced apart so far that electric current cannot bridge the gap.

Such actual contact between the electrodes will occur if the electrode surfaces are formed of a material (e.g., noble metals) which are inert with respect to oxygen. In the case of metals which react with oxygen, however, a thin insulative oxide film may form on the electrode surfaces, whereby current flows across the peaks by way of a quantum tunneling effect, rather than as a result of direct contact between the conductive metals, thereby further inhibiting the current flow.

The other shortcoming, i.e., bounce, can occur when the ball impacts against a fixed electrode, or as vibrations occur after contact is made. The impact or vibrations can cause the ball to move away from the fixed electrode, thereby intermittently opening and closing the circuit.

It would be desirable to provide a switch, especially a tilt switch, which minimize or obviates those shortcomings.

SUMMARY OF THE INVENTION

The present invention relates to an electric switch, such as a tilt switch, which comprises a casing forming a chamber. A fixed electrode having a fixed surface is disposed in the chamber. A movable electrode having a movable surface is disposed in the chamber for movement toward and away from the fixed electrode between current-conducting and current non-conducting positions, respectively. A dielectric liquid is disposed in the chamber. The liquid is either a non-polar liquid, or a weakly charged polar liquid (i.e., a liquid having a dipole moment less than 1.5 Debye). The liquid is wettable to the fixed and movable surfaces for drawing the surfaces sufficiently close together in the current conducting position, whereby a current flow therethrough is enhanced by a quantum tunneling effect.

In a tilt switch, the movable electrode acts as a shorting element to short out two fixed electrode surfaces.

BRIEF DESCRIPTION OF THE DRAWING

The objects and advantages of the invention will become apparent from the following detailed description of a preferred embodiment thereof in connection with the accompanying drawing in which like numerals designate like elements and which.

DETAILED DESCRIPTION OF A PREFERRED EMBODIMENT OF THE INVENTION

Figure 1:
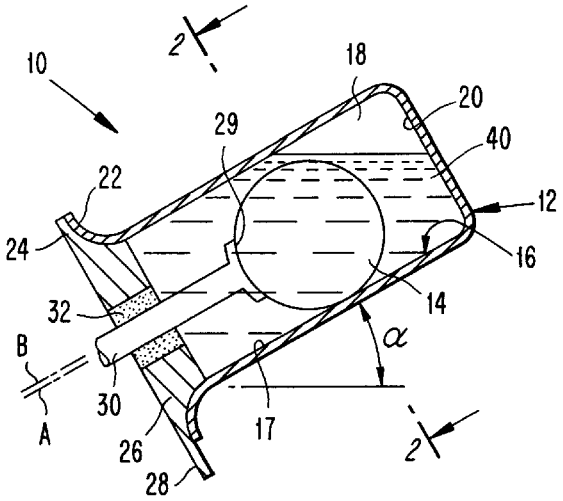
FIG. 1 is a sectional view taken through a tilt switch in a current-conducting state.
Figure 2:
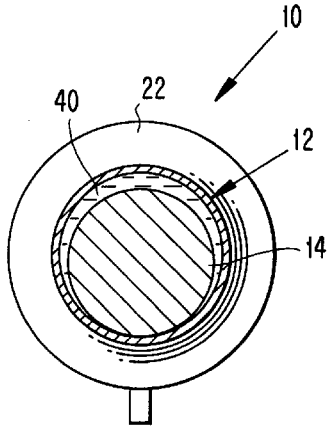
FIG. 2 is a sectional view taken along a line 2—2 in FIG. 1.

A preferred embodiment of the invention is in the form of a tilt switch 10 depicted in FIGS. 1 and 2. The switch comprises a case 12 and a ball-shaped, i.e., spherical, shorting member (or movable electrode) 14 displaceably mounted within a chamber 18 formed by the casing. The casing is shown as inclined at an acute angle $\alpha$ relative to horizontal. The inner surface 16 of the casing, which includes a cylindrical portion 17 and a circular end portion 20, is symmetrically configured about a longitudinal axis B of the chamber, and is formed of an electrically conductive material such as a metal (e.g., copper, brass, and noble metals). The surfaces 16, 20 constitute a first fixed electrode in the sense that they are fixed with respect to the casing. The diameter of the cylindrical portion is larger than the diameter of the shorting member 14, so that the shorting member 14 can roll freely along the surface 16.

At an end of the casing opposite the circular surface portion 20, an electrically conductive fixed terminal 30 is sealed by an insulator 32 within a conductive shell 26, which shell has an extended flange 24 welded to an extended flange 22 of the case 12. The conductive shell has a tab 28 which provides for electrical termination of the case, which as noted above also functions as a fixed electrode. An end of the terminal 30 projects into the chamber 18 and includes a terminal surface 29 desirably, but not necessarily, shaped as a spherical segment of the same diameter as the sphere 14 to maximize the contact area. Other surface shapes could be used as well, such as a flat surface or a cylindrical surface. The shorting element could be of shapes other than spherical, as long as it is freely movable.

Figure 3:
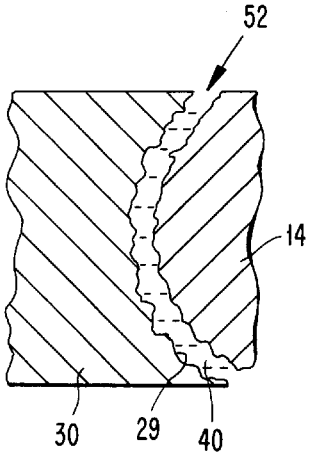
FIG. 3 is an enlarged fragmentary view of surfaces of respective electrodes of the tilt switch shown in FIG. 1.

The terminal 30 extends along an axis A, which axis A is offset relative to the axis B so that when the shorting member 14 rolls into contact with terminal 30, the axis A will pass through the geometrical center of the shorting member 14 for alignment of that member on the terminal face 29. The mutually contacting faces of the terminal 30 and sphere 14 define an electrically conductive interface 52 (see FIG. 3). In a similar manner, the diameter of the shorting member 14 is preferably selected to maximize the contact area with the inner surface 17 of the casing at an interface established therebetween. The contacting faces can be formed of any suitably conductive material such as non-ferrous material (preferably copper), gold, etc.

As thus far described, the switch is of a conventional nature.

The present invention is based upon the inventor's discovery that surface tension characteristics of liquids can be used to increase conductivity in switches of the type wherein relative movement occurs between electrodes, especially a tilt switch which, until now, has relied solely upon the force of gravity for urging the shorting element against the fixed electrodes. In accordance with the present invention, the chamber 18 contains a suitable volume of a dielectric liquid (i.e., an electrically insulative liquid) which is capable of "wetting" to the surfaces 29 and 16 of the fixed electrodes 30 and 12, respectively, and to the surface of the shorting element 14. When a liquid is wetted to a solid surface, the surface tension of the liquid causes the liquid to spread over the surface. Technically speaking, a liquid is said to be wettable to a solid if the contact angle between the solid and the liquid, measured through the liquid, lies between 0 and 90°, and not to wet the solid if the contact angle lies between 90 and 180°. Increased wetting favors lower wetting angles.

Figure 4:
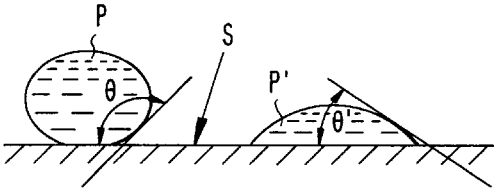
FIG. 4 is a view showing the effects of surface tension acting on liquid particles that are respectively wettable and non-wettable to a surface.

In that regard, there is depicted in FIG. 4 two liquid particles P and P' lying on a solid surface S. The particle P, which is not wetted to the surface, exhibits a contact angle θ greater than 90°, whereas the particle P ', which is wetted to the surface, exhibits a contact angle θ' less than 90°.

Figure 5A:
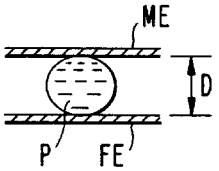
FIG. 5A is a schematic view of a non-wetted liquid disposed between two electrodes.

If the particle P were disposed between a fixed element FE and a movable element ME resting thereon, to which the particle is not wettable (see FIG. 5A), surface tension acting on the non-wetted particle P would tend to cause the particle to assume the shape depicted in FIG. 5A, forcing the elements apart by a distance D of such magnitude that electrical current could be conducted between the electrodes only if the liquid were an electrically conductive liquid. The use of electrically conductive liquids in a switch environment, however, gives rise to considerable complications involving unintended shorting-out of electrodes and thus has been avoided (except for the use of mercury which, as noted earlier, presents serious environmental hazards).

Figure 5B:
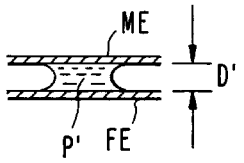
FIG. 5B is a schematic view of a wetted liquid disposed between two electrodes.

However, the present inventor has discovered that a dielectric liquid can be used in a switch to actually enhance current flow if the liquid is of the type that is wettable to the electrodes, and if the liquid is either non-polar (i.e., does not carry a charge) or is a weakly charged polar liquid, i.e., having a dipole moment less than 1.5 Debye. In that regard, it is shown in FIG. 5B that if the same electrodes depicted in FIG. 5A are in contact with a particle P' of such liquid, surface tension will cause the wetted particle to assume the shape shown in FIG. 5B and actually draw the electrodes toward one another, whereby the electrodes become spaced apart by a distance D' which is much shorter than the distance D of FIG. 5A. Even though the liquid is a dielectric, and even though the electrodes do not touch, they are now moved close enough to one another whereby electric current can flow due to quantum tunneling. Quantum tunneling is the ability of a particle to pass through a finite region in which the particle's potential energy is greater than its total energy. This is a quantum-mechanical phenomenon which, although seemingly impossible under classical mechanics theory, explains why current can pass through an interface even though the interface is coated with an insulating oxide.

If the chamber 18 of the tilt switch contains a non-polar dielectric liquid or a weakly charged polar dielectric liquid, wherein the liquid is wetted to the surfaces 16, 29 of both fixed electrodes and the movable shorting element 14, then when the element 14 travels along the electrode surface 16 and approaches the electrode surface 29, surface tension acting on the liquid draws the surface of the shorting element 14 very close to the surfaces 16, 29, whereby current flow therebetween is enhanced by a quantum tunneling effect.

As noted earlier, a problem existing in connection with ball-type tilt switches wherein the chamber 18 is filled with a gaseous environment, i.e., a dry switch, is low current carrying capacity. That is due to the irregular surface profiles of the element 14 and surfaces 16, 29. Because of those irregularities, the element 14 will actually contact the surfaces 16, 29 at a total of three points, i.e., either (a) at two points with the surface 16 and one point with the surface 29, or (b) at one point with the surface 16 and two points with the surface 29. Current can flow at those three points, but current flow at adjacent points is impeded by the resulting gas environment gap that is created. (Note: current flow due to a quantum tunneling effect through gas is inconsequential unless electric breakdown (i.e., arcing) occurs which will destroy the switch.) The three-point contact is often insufficient to conduct the necessary current. The presence of a dielectric liquid to which the contact surfaces are non-wetted would result in an inoperative switch, because the electrode surfaces would be forced apart so far that no current flow could take place.

To overcome the three-point contact problem, conventional switches mechanically increase the contact force (e.g., by means of springs) to compress the contact points and thus increase the size of the contact area. However, that would be impractical in a tilt switch, for example, wherein the shorting element must be capable of relatively free movement.

However, in accordance with the present invention, the presence of a dielectric liquid that is wetted to the electrode surfaces will cause the surfaces to be pulled so closely together that current can flow due to the quantum tunneling effect. Current will flow not merely at a few points as in the case of a dry switch, but rather along an extended area in which the electrodes have been drawn close to each other by surface tension. Thus, in effect, the current-conducting surface area is increased by the liquid to include closely adjacent non-contacting regions of the electrodes which might otherwise have been incapable of conducting current.

Furthermore, the surface tension force which pulls the electrodes together may be of sufficient magnitude to somewhat deform (compress) the above-mentioned contact points (especially when the contact points are only of atomical size in dimension so that they are capable of being compressed by the force generated by surface tension), whereby the electrodes are brought even closer. An important advantage of the invention is that it is irrelevant whether the liquid wets to the insulative surfaces, since the liquid is a dielectric. Accordingly, the feature which previously made the use of mercury so desirable (i.e., its ability to wet to the conductive surfaces but not to the insulative surfaces) need no longer be a consideration. The liquid will be acceptable even if it wets to every surface within the switching chamber.

In one successful example of the invention, the case surface 16, the electrode surface 29, and the surface of the shorting element 14 were all formed of copper, and the dielectric liquid capable of wetting to all of those surfaces was polyphenyl ether. Other suitable types of non-polar liquids that can be employed include esters (such as dioctyl sebacate), silicones (such as DC200), polyolefins, polyethylene glycols, fluorinated polyethers, various vegetable oils such as soybean oil, various mineral oils, various aromatic and aliphatic liquids. An example of a weakly charged polar liquid that can be used is lecithin (i.e., phosphatidyl choline) which may be modified by solubilizing in a non-polar liquid such as mineral oil to have an effective dipole moment less than 1.5 Debye.

The term "liquid" as used herein may include a blend of liquids, such as vegetable oil blended with mineral oil, whereby the viscosity of a liquid having a suitable surface tension can be favorably varied.

It is also possible to chemically treat certain substances to make them wettable by certain liquids and such treated substances are included within the scope of this invention.

It has been found that the use of liquids having a surface tension of 50 dynes/cm or less will enable most electrode materials to be wetted, while liquid viscosities of under 300 centistokes at 20–25° C. will still allow the electrodes to come into close proximity with each other, depending on the contact force. Liquids having a surface tension higher than 50 dynes/cm may also work, but greater surface tensions may be associated with reduced wettability. Thus, most of the suitable liquids will have a surface tension less than 50 dynes/cm. Since liquids with high viscosity will tend to force the electrode surfaces apart more so than liquids with low viscosity, it is necessary to select a liquid whose viscosity will enable the electrode surfaces to be pulled closely together by the surface tension, e.g., preferably wherein the resulting thickness of the liquid between the electrode surfaces will be the size of only a few molecule diameters of the liquid.

It may be particularly desirable in practicing the invention to intentionally roughen the surfaces of the electrodes to create a series of points that will lie closely adjacent one another, separated only by the wettable dielectric liquid, whereby current flow by quantum tunneling can occur at numerous closely adjacent points.

Other side benefits resulting from the flooding of the chamber 18 with a wettable dielectric liquid is that, depending upon which dielectric is selected, oxidation of the electrode surfaces will not occur, and also that the liquid dampens the motion of the shorting element 14 to minimize bouncing of the shorting element. By preventing the formation of oxide films, the resulting resistance to current flow will not occur, and low-cost materials such as copper and brass can be utilized as the electrode materials.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. An electrical switch, comprising:

a casing forming a chamber;

a fixed electrode having a fixed surface disposed in the chamber;

a movable electrode having a movable surface disposed in the chamber for movement toward and away from the fixed electrode between current-conducting and current non-conducting positions, respectively; and a non-polar dielectric liquid disposed in the chamber, the liquid being wettable to the fixed and movable surfaces so that surface tension draws the surfaces sufficiently close together in the current-conducting position, whereby a current flow therethrough is enhanced by a quantum tunneling effect.

2. The switch according to claim 1 wherein the surface tension of the liquid is less than 50 dynes/cm.

3. The switch according to claim 2 wherein the liquid has a viscosity below 300 centistokes at 20–25° C.

4. The switch according to claim 1 wherein the liquid has a viscosity below 300 centistokes at 20–25° C.

5. An electrical tilt switch, comprising:

a tiltable casing forming a chamber having a first fixed electrode surface;

a fixed electrode extending into the chamber and having a second fixed electrode surface;

a shorting element having an outer surface, the shorting element being movable along the first fixed electrode surface between current-conducting and non-current conducting relationship with the second fixed electrode surface depending upon a tilt angle of the casing; and a non-polar dielectric liquid disposed in the chamber, the liquid being wettable to the first and second fixed electrode surfaces, and to the outer surface of the shorting element so that surface tension draws the surfaces sufficiently close together in the current-conducting position, whereby a current flow therethrough is enhanced by a quantum tunneling effect.

6. The switch according to claim 5 wherein the first fixed electrode surface is cylindrical.

7. The switch according to claim 6 wherein the surface of the shorting member is spherical.

8. The switch according to claim 7 wherein the surface tension of the liquid is less than 50 dynes/cm.

9. The switch according to claim 8 wherein the liquid has a viscosity below 300 centistokes at 20–25° C.

10. The switch according to claim 7 wherein the liquid has a viscosity below 300 centistokes at 20–25° C.

11. An electrical switch, comprising:

a casing forming a chamber;

a fixed electrode having a fixed surface disposed in the chamber;

a movable electrode having a movable surface disposed in the chamber for movement toward and away from the fixed electrode between current-conducting and current non-conducting positions, respectively; and a polar dielectric liquid having a dipole moment less than 1.5 Debye disposed in the chamber, the liquid being wettable to the fixed and movable surfaces so that surface tension draws the surfaces sufficiently close together in the current-conducting position, whereby a current flow therethrough is enhanced by a quantum tunneling effect.

12. The switch according to claim 11 wherein the surface tension of the liquid is less than 50 dynes/cm.

13. The switch according to claim 12 wherein the liquid has a viscosity below about 300 centistokes at 20–25° C.

14. The switch according to claim 11 wherein the liquid has a viscosity below about 300 centistokes at 20–25° C.

15. An electrical tilt switch, comprising:

a tiltable casing forming a chamber having a first fixed electrode surface;

a fixed electrode extending into the chamber and having a second fixed electrode surface;

a shorting element having an outer surface, the shorting element being movable along the first fixed electrode surface between current-conducting and non-current conducting relationship with the second fixed electrode surface depending upon a tilt angle of the casing; and a polar dielectric liquid having a dipole moment less than 1.5 Debye disposed in the chamber, the liquid being wettable to the first and second fixed electrode surfaces, and to the outer surface of the shorting element so that surface tension draws the surfaces sufficiently close together in the current-conducting position, whereby a current flow therethrough is enhanced by a quantum tunneling effect.

16. The switch according to claim 15 wherein the first fixed electrode surface is cylindrical.

17. The switch according to claim 16 wherein the surface of the shorting member is spherical.

18. The switch according to claim 17 wherein the surface tension of the liquid is less than 50 dynes/cm.

19. The switch according to claim 18 wherein the liquid has a viscosity below 300 centistokes at 20–25° C.

20. The switch according to claim 17 wherein the liquid has a viscosity below 300 centistokes at 20–25° C.

* * * * *